US010308474B2

(12) United States Patent
Love et al.

(10) Patent No.: US 10,308,474 B2
(45) Date of Patent: Jun. 4, 2019

(54) FILM DISPENSER

(71) Applicant: Inteplast Group Corporation, Livingston, NJ (US)

(72) Inventors: James R. Love, Sand Springs, OK (US); Scott Stevens, Edna, TX (US)

(73) Assignee: Inteplast Group Corporation, Livingston, NJ (US)

( * ) Notice: Subject to any disclaimer, the term of this patent is extended or adjusted under 35 U.S.C. 154(b) by 490 days.

(21) Appl. No.: 15/070,923

(22) Filed: Mar. 15, 2016

(65) Prior Publication Data

US 2016/0289033 A1 Oct. 6, 2016

Related U.S. Application Data

(60) Provisional application No. 62/141,050, filed on Mar. 31, 2015.

(51) Int. Cl.
*B65H 75/18* (2006.01)

(52) U.S. Cl.
CPC ..... *B65H 75/185* (2013.01); *B65H 2301/418526* (2013.01); *B65H 2701/18422* (2013.01); *B65H 2701/1944* (2013.01)

(58) Field of Classification Search
CPC ..... B65H 75/185; B65H 2701/18422; B65H 2301/418526; B65H 2701/1944; B65H 75/18
See application file for complete search history.

(56) References Cited

U.S. PATENT DOCUMENTS

| | | | | | |
|---|---|---|---|---|---|
| D35,200 | S | | 10/1901 | Levy | |
| 1,098,479 | A | * | 6/1914 | Clark | B65H 75/22 242/599.1 |
| 1,248,017 | A | * | 11/1917 | Sande | B42D 19/00 242/118.4 |
| 1,410,014 | A | * | 3/1922 | Hurlburt | B41L 19/00 242/587.2 |
| 2,064,067 | A | | 12/1936 | Knorr | |
| D106,053 | S | | 9/1937 | Maguire | |
| 2,346,075 | A | * | 4/1944 | Mihalyi | G03B 17/30 242/578.3 |
| 2,644,383 | A | | 7/1953 | Meditz | |
| D202,801 | S | | 11/1965 | Whitten | |
| 3,221,868 | A | | 12/1965 | Ricker et al. | |

(Continued)

*Primary Examiner* — William A. Rivera
(74) *Attorney, Agent, or Firm* — Stinson Leonard Street LLP

(57) ABSTRACT

A film dispenser for use in unwinding film from coreless film rolls. A first dispenser member is selectively matable with a second dispenser member. The first and second dispenser members can be mated together in at least two angular positions. The position of a radially outward facing surface of the dispenser can be adjusted based on the angular position of the dispenser members so that the dispenser can firmly engage and support film rolls of varying internal dimensions. Each of the dispenser members can have a radially extending support wall. The support walls define complementary interlocking formations. When the dispenser members are mated together, the complementary interlocking formations engage one another to form a rigid connection between the dispenser members. The engaged support walls radially support a central region of the film roll.

21 Claims, 11 Drawing Sheets

(56) References Cited

U.S. PATENT DOCUMENTS 3,768,242 A * 10/1973 Angst ..... D01H 1/385 57/303
3,831,824 A 8/1974 Coppersmith
4,248,392 A 2/1981 Parry
4,312,347 A 1/1982 Magoon et al.
4,484,717 A 11/1984 Goldstein
4,574,020 A 3/1986 Fosnaught
D299,353 S 1/1989 Goldstein
D299,654 S 1/1989 Goldstein
D311,296 S 10/1990 Santoiemmo
5,135,179 A 8/1992 Morano
D332,198 S 1/1993 Goodman, Jr.
D340,822 S 11/1993 Morand
5,570,564 A 11/1996 Moore et al.
D389,364 S 1/1998 Vallarella et al.
D394,178 S 5/1998 Gremchuck
D396,589 S 8/1998 Daansen
D414,361 S 9/1999 Senecal, Jr.
5,996,473 A 12/1999 Milone
D420,025 S 2/2000 Gabriele
6,019,308 A 2/2000 Huang
D423,913 S 5/2000 Dougan, Jr.
D424,167 S 5/2000 Yuen et al.
6,230,999 B1 5/2001 Tanaka
D447,043 S 8/2001 Wyers
D453,644 S 2/2002 Baggett
6,676,069 B1 * 1/2004 Davis ..... B65H 75/146 242/405.2
D495,176 S 8/2004 Wolpert et al.
D498,967 S 11/2004 White
D537,722 S 3/2007 Jaichandra et al.
D565,387 S 4/2008 Remark et al.
D570,687 S 6/2008 Kelders et al.
7,438,254 B2 10/2008 Oettershagen
D579,761 S 11/2008 Tooman
D587,584 S 3/2009 Jaichandra et al.
7,537,140 B2 5/2009 Lin
D603,206 S 11/2009 Wallace
7,665,686 B2 2/2010 Becker et al.
D632,512 S 2/2011 Bejdova
7,937,915 B2 5/2011 Kohn et al.
D641,468 S 7/2011 Ruiz, Sr. et al.
D649,570 S 11/2011 Chen
8,302,435 B2 11/2012 Burmesch et al.
D688,138 S 8/2013 Kim
8,499,946 B2 8/2013 Giles et al.
8,616,490 B2 12/2013 Blok
D697,332 S 1/2014 Huang
D699,064 S 2/2014 Katterheinrich et al.
D707,532 S 6/2014 Stangl et al.
D719,826 S 12/2014 Burnside
D729,608 S 5/2015 Kalous et al.
D738,414 S 9/2015 Chen
9,150,381 B2 10/2015 Li et al.
D745,364 S 12/2015 Chen et al.
D748,476 S 2/2016 Lakstins
D786,699 S 5/2017 Shipulin
2002/0108407 A1 8/2002 Zapushek
2003/0223914 A1 12/2003 After et al.
2004/0098952 A1 5/2004 Burdorff
2004/0118962 A1 * 6/2004 Limber ..... B65H 75/14 242/405.2
2005/0145406 A1 7/2005 Hall et al.
2007/0151208 A1 7/2007 Huang
2009/0084074 A1 4/2009 Barbery
2009/0308968 A1 12/2009 Piotrowski et al.
2011/0041458 A1 2/2011 Yu Chen
2011/0042504 A1 2/2011 Yu Chen
2011/0284572 A1 11/2011 Meyer et al.
2012/0193388 A1 8/2012 Machota
2013/0186997 A1 7/2013 Martinez et al.
2013/0227913 A1 9/2013 Harrison
2015/0321800 A1 11/2015 Viale et al.
2016/0347574 A1 * 12/2016 Yu Chen ..... B65H 75/242

* cited by examiner

FILM DISPENSER

CROSS REFERENCE TO RELATED APPLICATIONS

This application claims priority to U.S. Provisional Patent Application Ser. No. 62/141,050, filed Mar. 31, 2015 and entitled "FILM DISPENSER," which is incorporated by reference for all purposes.

FIELD

The present disclosure generally relates to a film dispenser for unwinding film from a film roll and more specifically to a reusable film dispenser for repeatable use with coreless film rolls.

BACKGROUND

Film from film rolls is often used in packaging applications. For example, the contents of a pallet can be bundled together with a stretch wrap film (e.g., a pre-stretched film or a post-stretched film) made from a polyethylene resin or other material. Conventionally, stretch wrap film is wrapped around a tubular core defining an axially extending roll axis passage of the film roll of substantially fixed dimensions. The film is subsequently unwound from the core in use in a packaging application. Dispensers can be installed in the core to aid in unwinding the film from the roll. Conventional dispensers have a hub that extends into a roll axis passage of the film roll and engages the core. A handle member is mounted on the hub for rotation with respect to the hub. The handle member can be held in the hand of a user who manually unwinds the film from the roll or attached to an automated wrapping apparatus such as a palletizer. As film is unwound from the roll, the hub and film roll rotate mutually and in a controlled fashion with respect to the handle member.

The use of cores in film rolls increases the overall cost of the film to the end user. Coreless film rolls are known to those skilled in the art and provide cost advantages over traditional film rolls. A coreless film roll has a roll axis passage, but no core inside the passage to keep its dimensions uniform. Because of the tendency of the film, and particularly pre-stretch film, to change dimensions after it is wound into the roll, the dimensions of roll axis passages in coreless film rolls are highly variable. Moreover, the roll axis passage may have significantly different dimensions at different locations along its length. Thus, traditional film dispensers that are only operable with roll axis passages adhering to strict dimensional requirements are not operable for use with coreless film rolls of varying internal dimensions. The roll axis passage may be too small to receive the dispenser hub or may cause damage to the film when the hub is inserted. If the roll axis passage is too much larger than the dispenser hub, the roll may rotate or "skip" relative to the hub in use, which is not desirable. Coreless film rolls also lack the structural rigidity of a rigid core. As a result, handling of coreless film rolls can cause bowing or other deformation of the roll, particularly as the roll is nearly used up. Moreover, it is essential that changeover from one film roll to the next be done quickly and accurately. A dispenser hub that cannot be rapidly and precisely applied will not be used by consumers of plastic film because of economic inefficiency.

SUMMARY

In one aspect, a film dispenser can be used to unwind film from coreless film rolls, each having a roll axis passage including first and second openings at opposite ends of the coreless film roll. The film dispenser comprises a first dispenser member having an outer axial end portion and an inner axial end portion opposite the outer axial end portion. The inner axial end portion of the first dispenser member is shaped and arranged to be inserted into the first opening at one end of the coreless film roll. The inner axial end portion of the first dispenser member is radially expandable to engage the coreless film roll in the roll axis passage. A second dispenser member has an outer axial end portion and an inner axial end portion opposite the outer axial end portion. The inner axial end portion of the second dispenser member is shaped and arranged to be inserted into the second opening at another end of the coreless film roll. The second dispenser member is configured to engage the first dispenser member. The first and second dispenser members are selectively positionable relative to one another when interengaged in at least a first angular position and a second angular position. The inner axial end portion of the first dispenser member has a first radial position upon engagement of the first and second dispenser members in the first angular position. The inner axial end portion of the first dispenser member is expanded to a second radial position upon engagement of the first and second dispenser members in the second angular position. The second radial position is radially outward of the first radial position.

In another aspect, a film dispenser can be used to unwind film from coreless film rolls, each having a roll axis passage including first and second openings at opposite ends of the coreless film roll. The film dispenser comprises a first dispenser member having a longitudinal axis, an outer axial end portion, and an inner axial end portion spaced apart from the outer axial end portion along the longitudinal axis. The inner axial end portion of the first dispenser member is shaped and arranged to be inserted into a first opening of a roll axis passage of the film roll. The first dispenser member further comprises an axially inward facing support wall including a first interlocking formation. A second dispenser member has a longitudinal axis, an outer axial end portion, and an inner axial end portion spaced apart from the outer axial end portion along the longitudinal axis. The inner axial end portion of the second dispenser member is shaped and arranged to be inserted into the second opening of the roll axis passage. The second dispenser member is shaped and arranged to engage the first dispenser member. The second dispenser member further comprises an axially inward facing support wall including a second interlocking formation configured for interlocking engagement with the first interlocking formation when the second dispenser member engages the first dispenser member within the roll axis passage for supporting an axial mid-portion of the coreless film roll.

Other aspects, objects, and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
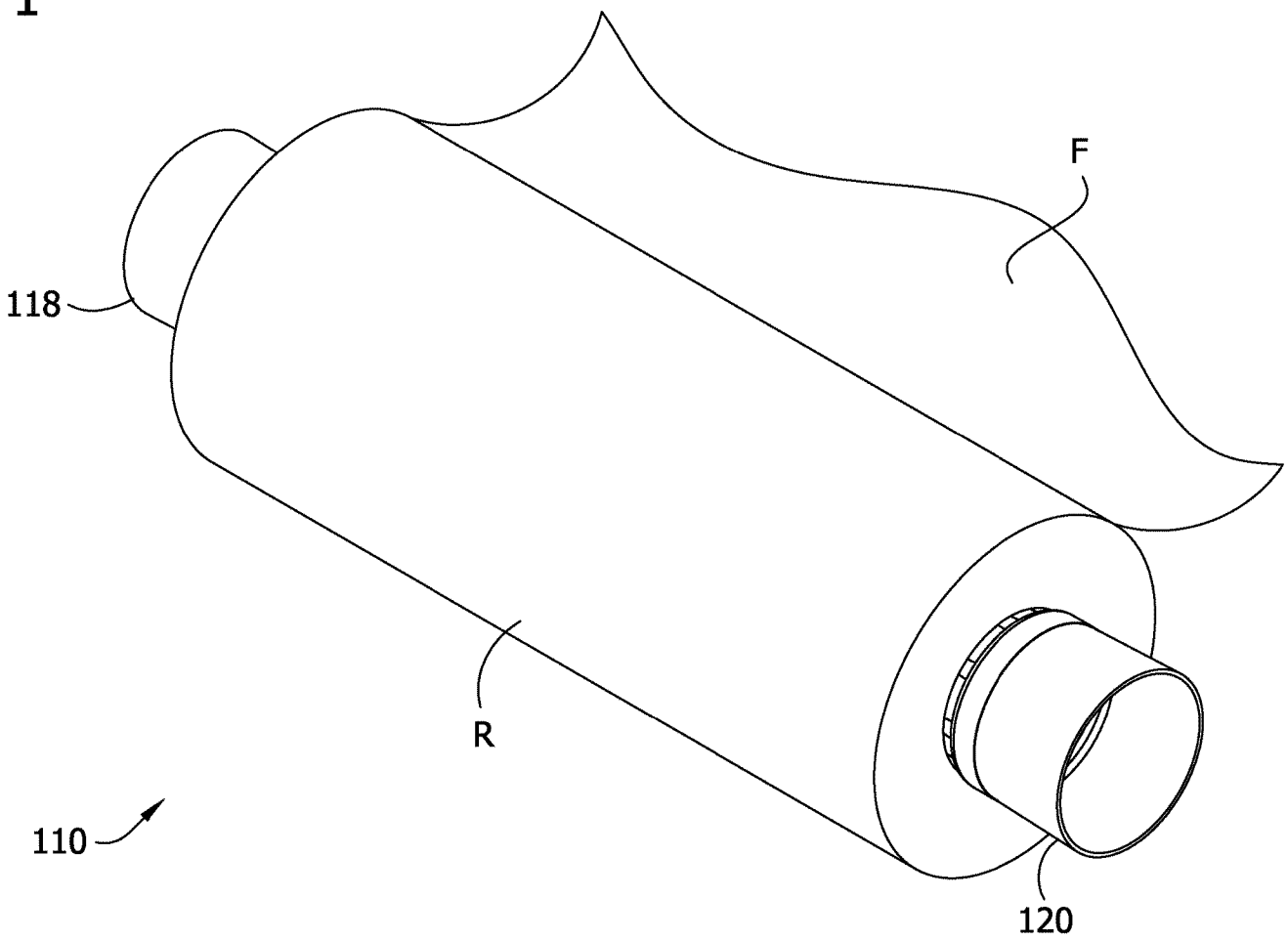
FIG. 1 is a perspective a film dispenser installed in a film roll.
Figure 1A:
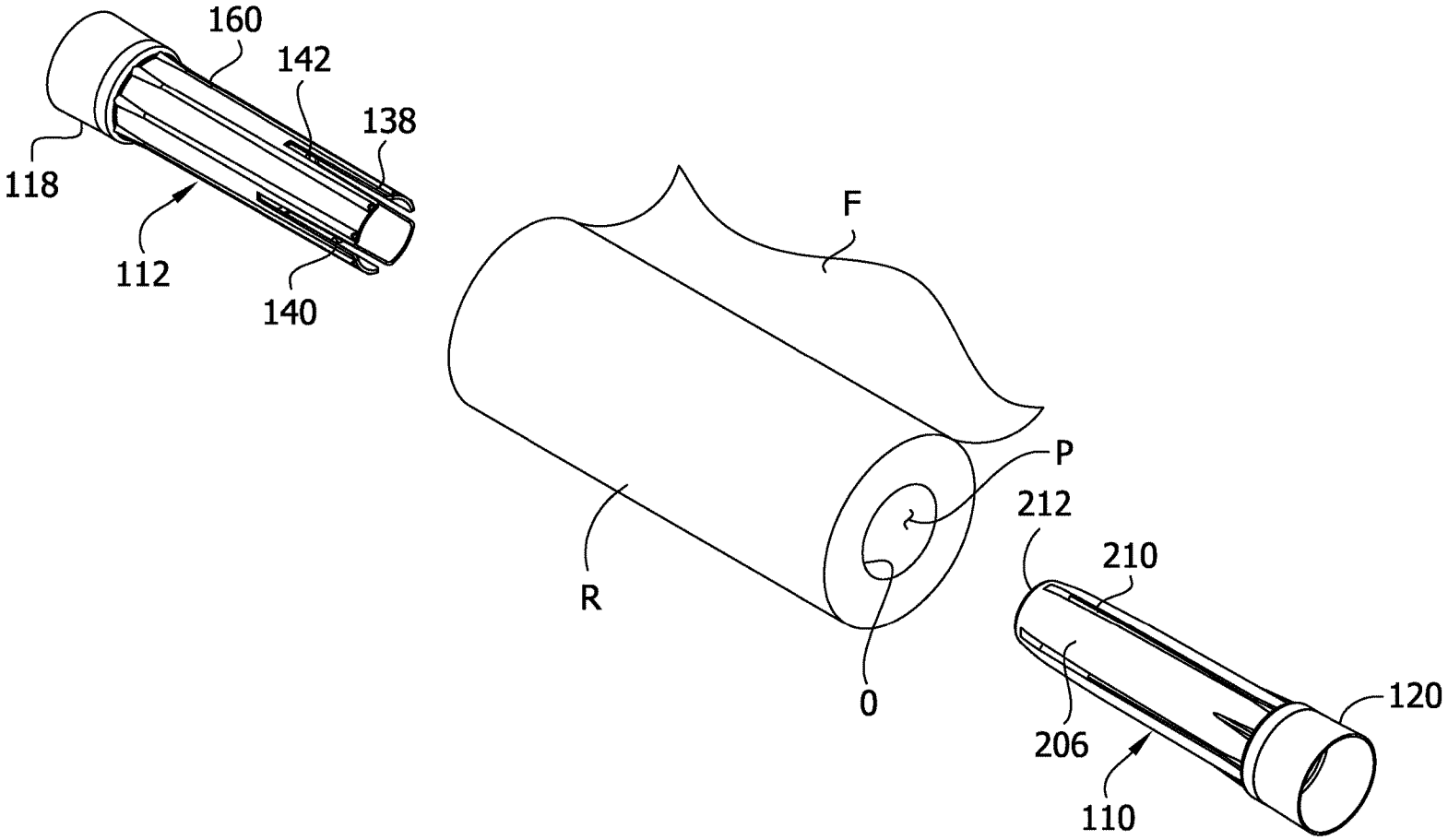
FIG. 1A is the perspective of FIG. 1 with the film dispenser exploded from the film roll.
Figure 2:
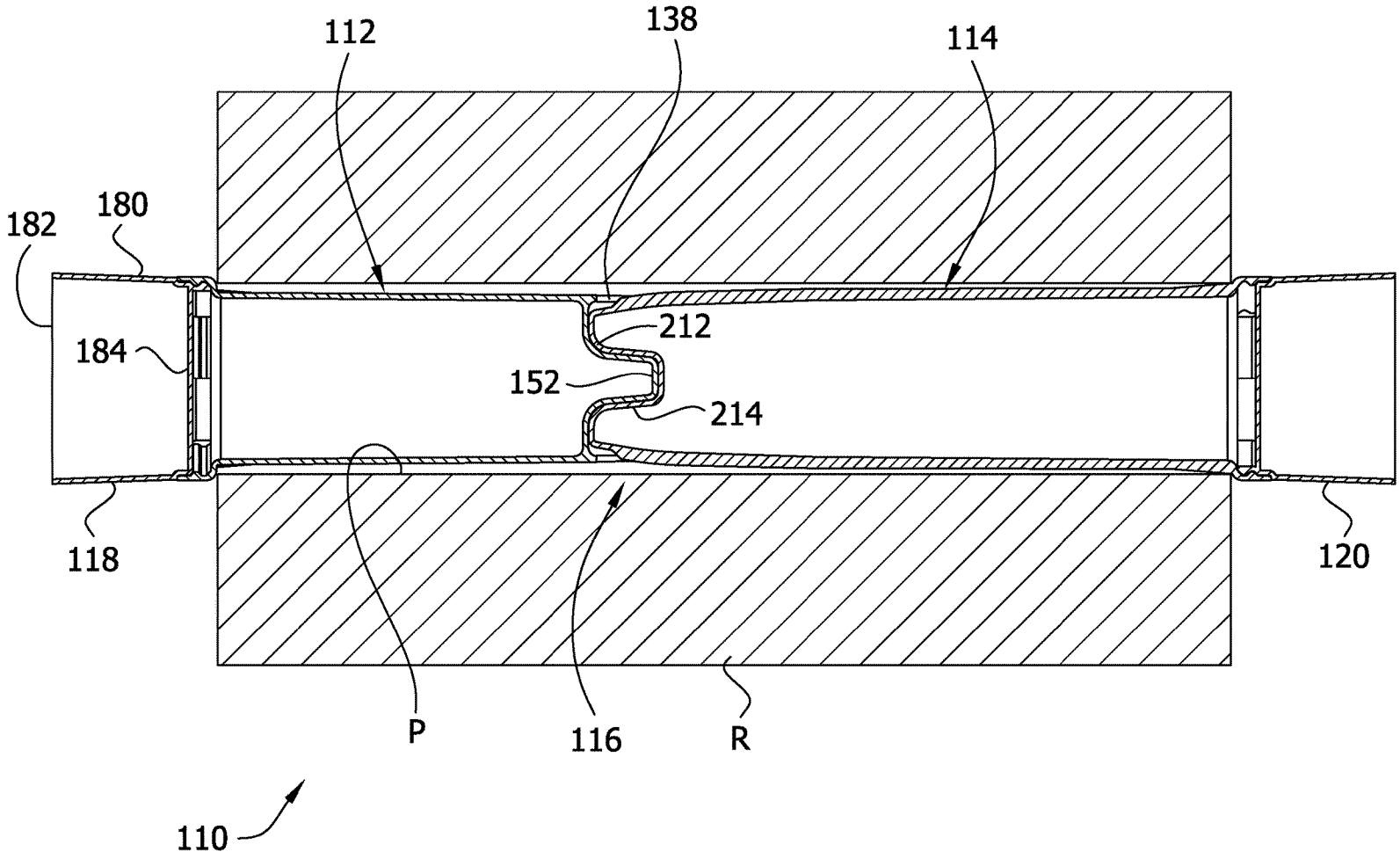
FIG. 2 is a longitudinal section of the film dispenser installed in the film roll.

Referring to FIGS. 1-2, a film dispenser for unwinding film from a film roll R is generally indicated at reference numeral 110. The film dispenser 110 includes a female dispenser member, generally indicated at reference numeral 112, and a male dispenser member, generally indicated at reference numeral 114, that are configured to be inserted through respective first and second openings O into a roll axis passage P of the coreless film roll R. For purposes of this application the female dispenser member 112 may be considered one of first and second dispenser members and the male dispenser member 114 can be considered the other of the first and second dispenser members. The male and female dispenser members 112, 114 are mated together within the roll axis passage P of the coreless film roll R to form a dispenser hub, generally indicated at reference numeral 116, which engages a radially inward facing surface of the film roll to inhibit rotation of the film roll with respect to the dispenser members. The male and female dispenser members 112, 114 are mounted on handle members 118, 120, respectively, for rotation with respect to the handle members. The handle members 118 are adapted to be grasped by the hands of a user or a fixture of an unwinding apparatus in use. When a free end F of the film is fixed to an item to be wrapped (not shown) and the handle members 118, 120 are supported, the film roll R and dispenser hub 116 rotate conjointly relative to the handle members to unwind film from the roll as the dispenser 110 is moved around the item. As will be apparent, the male and female dispenser members 112, 114 include features that enable the dispenser 110 to be repeatably used with a plurality of coreless film rolls R having roll axis passages P of varying dimensions. Moreover, the dispenser 110 provides structural support for a coreless film roll R when the male and female dispenser members 112, 114 are received therein.

Figure 3:
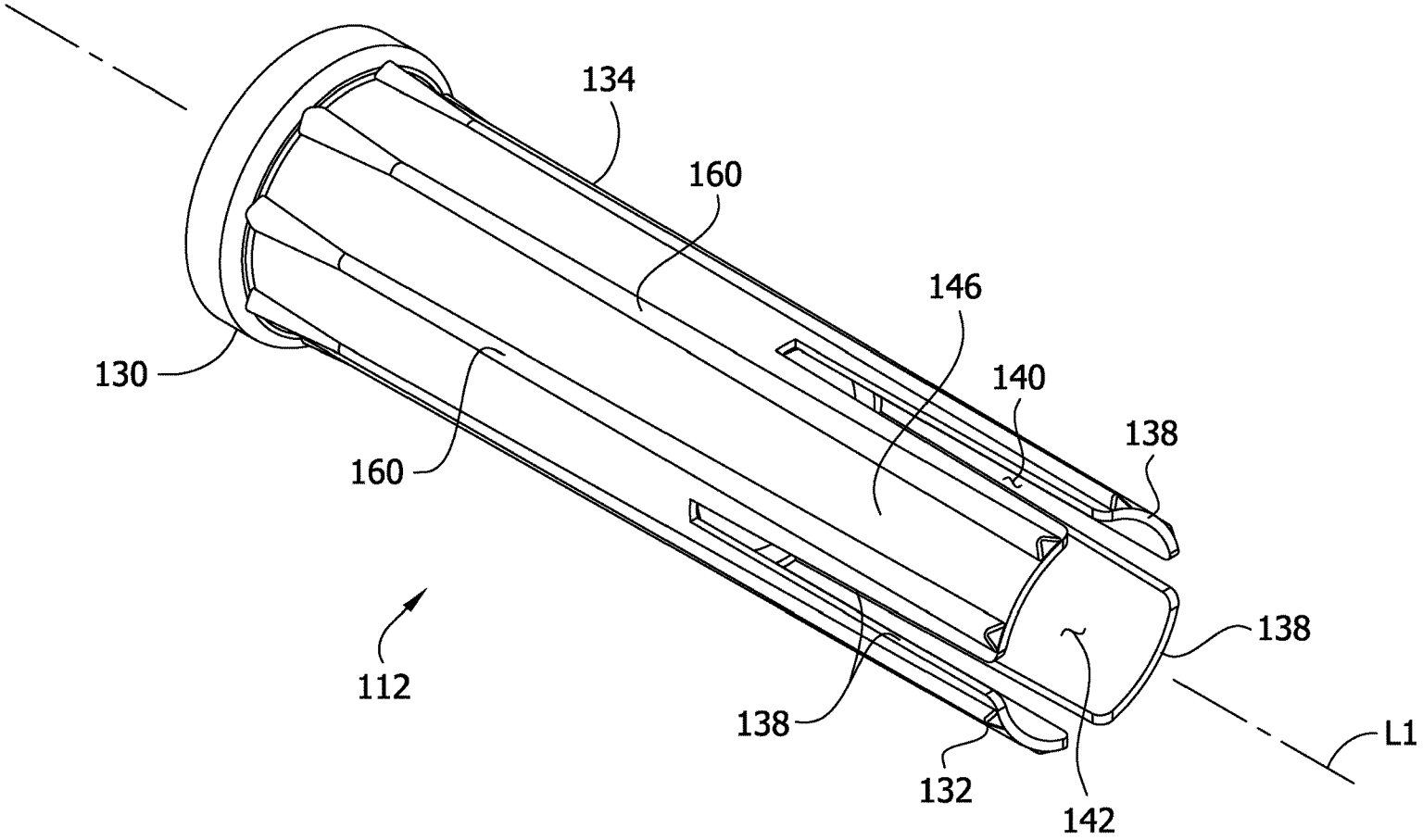
FIG. 3 is a perspective of a female dispenser member of the film dispenser.

Referring to FIG. 3, the illustrated female dispenser member 112 comprises a single one-piece, unitary structure of, for example, polyethylene, formed, for example, in an injection molding process. It will be understood that other materials and/or other manufacturing processes may be employed to make the female dispenser member 112 within the scope of the present invention. The female dispenser member 112 has an outer axial end portion 130 and an inner axial end portion 132 opposite the outer axial end portion. The female dispenser member 112 includes a longitudinal center axis L1. A generally cylindrical body 134 includes the outer and inner axial end portions 130, 132. As will be discussed in further detail below, the inner axial end portion 132 of the cylindrical body 134 is configured to be inserted into the first opening O of the roll axis passage P of the coreless film roll R and an outer axial end portion 130 of the cylindrical body is configured to secure the dispenser member to the handle member 118 for rotation.

The inner axial end portion 132 of the female dispenser member 112 includes four fingers 138. The fingers 138 can be resiliently deflected in a radially inward direction to be received in the roll axis passage P of the coreless roll R, and expandable radially outward to engage the radially inward facing surfaces of the film rolls R having roll axis passages of different radial dimensions. Four slots 140 in the inner axial end portion 132 of the female dispenser member 112 separate adjacent pairs of the fingers 138. As will be discussed in further detail below, the slots 140 act as indexing formations adapted to engage complementary indexing formations of the male dispenser member 114 to inhibit angular displacement of the female dispenser member 112 relative to the male dispenser member. Although the illustrated embodiment uses four fingers 138 and four slots 140, it will be understood that other embodiments could use other numbers of fingers and slots without departing from the scope of the invention.

Figure 4:
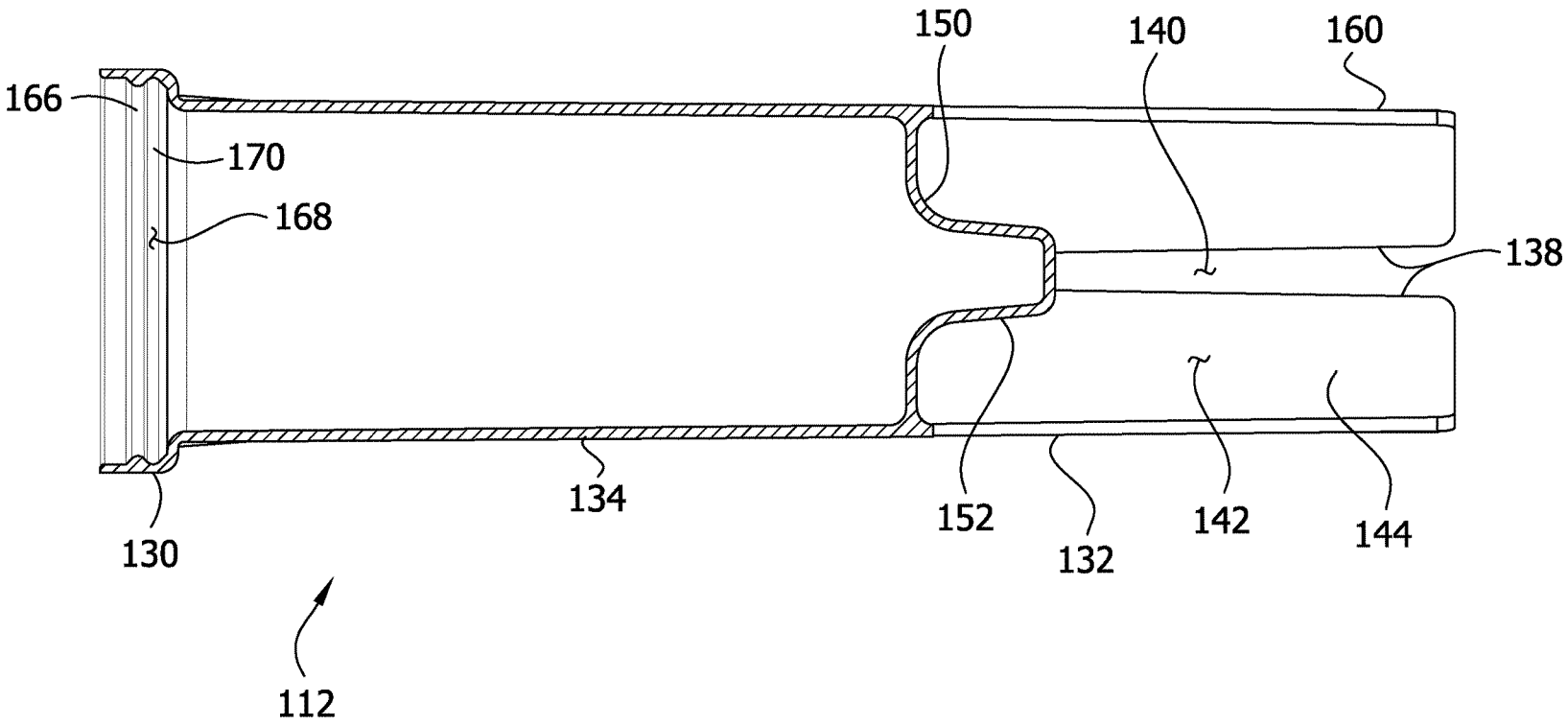
FIG. 4 is a longitudinal section of the female dispenser member.

The inner end portion of the cylindrical body 134 is shaped to define a mating socket 142 configured to receive a portion of the male dispenser member 114. Each of the fingers 138 has a radially inward facing surface 144 and a radially outward facing surface 146 opposite the radially inward facing surface thereof. The radially inward facing surfaces 144 bound a portion of the mating socket 142. When the male dispenser member 114 is received in the mating socket, it engages the radially inward facing surfaces 144 of the fingers 138 and deflects the fingers radially outwardly to engage the radially inward facing surface of the film roll R in the roll axis passage P. As shown in FIG. 4, an axially inward facing interior support wall 150 extending transverse (e.g., perpendicular) to the longitudinal axis L1 bounds an outer axial end of the mating socket 142.

The interior support wall 150 includes a projection 152 (broadly, a "first interlocking formation") extending axially inward into the mating socket 142. As will be discussed in further detail below, the projection 152 is configured to engage a complementary interlocking formation of the male dispenser member 114 to provide a rigid connection between the dispenser members 112, 114 when they are joined together to form the core hub 116 within the roll axis passage P of the coreless film roll R. Although the illustrated female dispenser member 112 uses the axially extending projection 150 to form a rigid connection with the male dispenser member 114, it will be understood that other embodiments can use other interlocking formations to connect the female dispenser member to the male dispenser member without departing from the scope of the invention. In the illustrated embodiment, the projection 152 is radially centered within the mating socket 136 on the longitudinal center axis L1 so that the projection is likewise radially centered within the roll axis passage P of the coreless film roll R when the female dispenser member 112 is received therein. In other embodiments, the projection can be offset from the longitudinal center axis L1 without departing from the scope of the invention.

Referring to FIG. 3, eight radially outwardly extending ribs 160 angularly spaced apart from one another around the circumference of the cylindrical body 134 extend along the length of the cylindrical body between the outer and inner axial end portions 130, 132. Although the illustrated embodiment includes eight outwardly extending ribs 160, it will be understood that other numbers of ribs or no ribs can also be used without departing from the scope of the invention. Likewise, the ribs can extend axially along different lengths of the female dispenser member 112 without departing from the scope of the invention. The radially outward facing surfaces of the ribs 160 are configured and arranged to engage and grip the film roll R within the roll axis passage P and thereby inhibit rotation of the film roll relative to the female dispenser member 112. Outer axial end portions of each of the ribs 160 flare radially outward beyond inner axial end portions thereof. The outer axial end portions of the ribs 160 slope inwardly from adjacent the outer axial end of the annular body 134. When the female dispenser member 112 is inserted into the first opening O of the roll axis passage P of the coreless film roll R, the outer axial end portions of the ribs 160 firmly engage the radially inward facing surface of the film roll R to provide radial support for the respective axial end of the film roll. The sloped configuration of the outer axial end portions enables the ribs 160 to firmly engage the outer ends of film rolls R with differing internal dimensions.

An inner end portion of each of the ribs 160 extends along the radially deflectable fingers 138. In the illustrated embodiment, one rib 160 is positioned adjacent each longitudinal side of each of the fingers 138. The inner end portions of the ribs 160 are configured to resiliently deflect radially outward along with the fingers 138. Thus, the radially outward facing surfaces of inner end portions of the ribs 160 are radially deflectable to engage the radially inward facing surfaces of film rolls R of different inner diameters within their respective roll axis passages P.

The outer axial end portion 130 of the cylindrical body 134 is configured to secure the female dispenser member to the handle member 118 for rotation relative to handle member. A collar 166 extends radially inward from the cylindrical body 134 at an axially outermost end of an annular recess 168 sized and shaped to receive a portion of the handle member 118 therein. When the female dispenser member 112 is mounted on the handle member 118, a radially inward facing rotational bearing surface 170 engages the handle member as the dispenser member rotates around the handle member.

Figure 5:
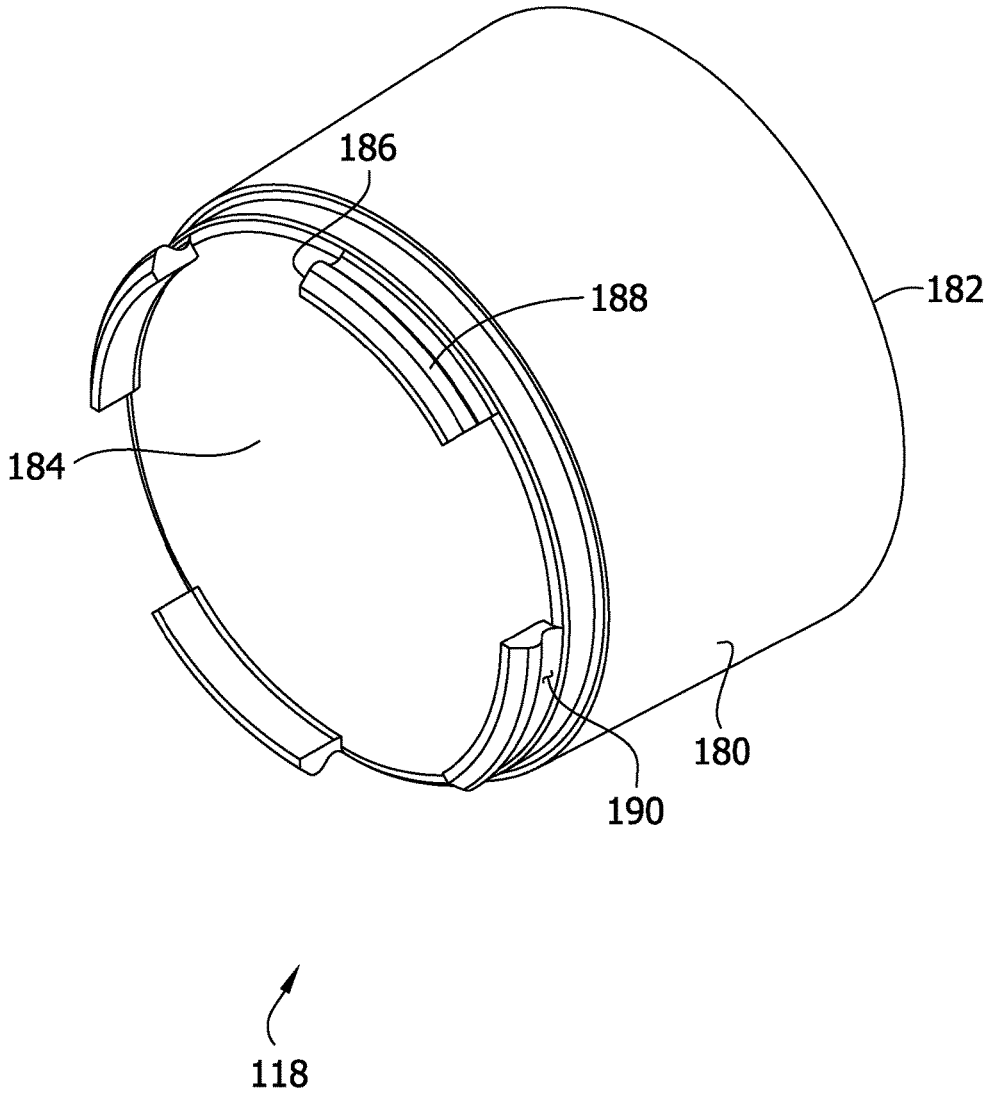
FIG. 5 is a perspective of a handle member.

Referring to FIG. 5, the handle member 118 comprises a cup-shaped body 180 having an open outer axial end 182 and a closed inner axial end 184. Four mounting tabs 186 extend axially from the inner axial end 184 of the cup-shaped body 180. Each of the four mounting tabs 186 comprises a radially outwardly extending flange portion 188 partially defining a collar-receiving recess 190.

Figure 6:
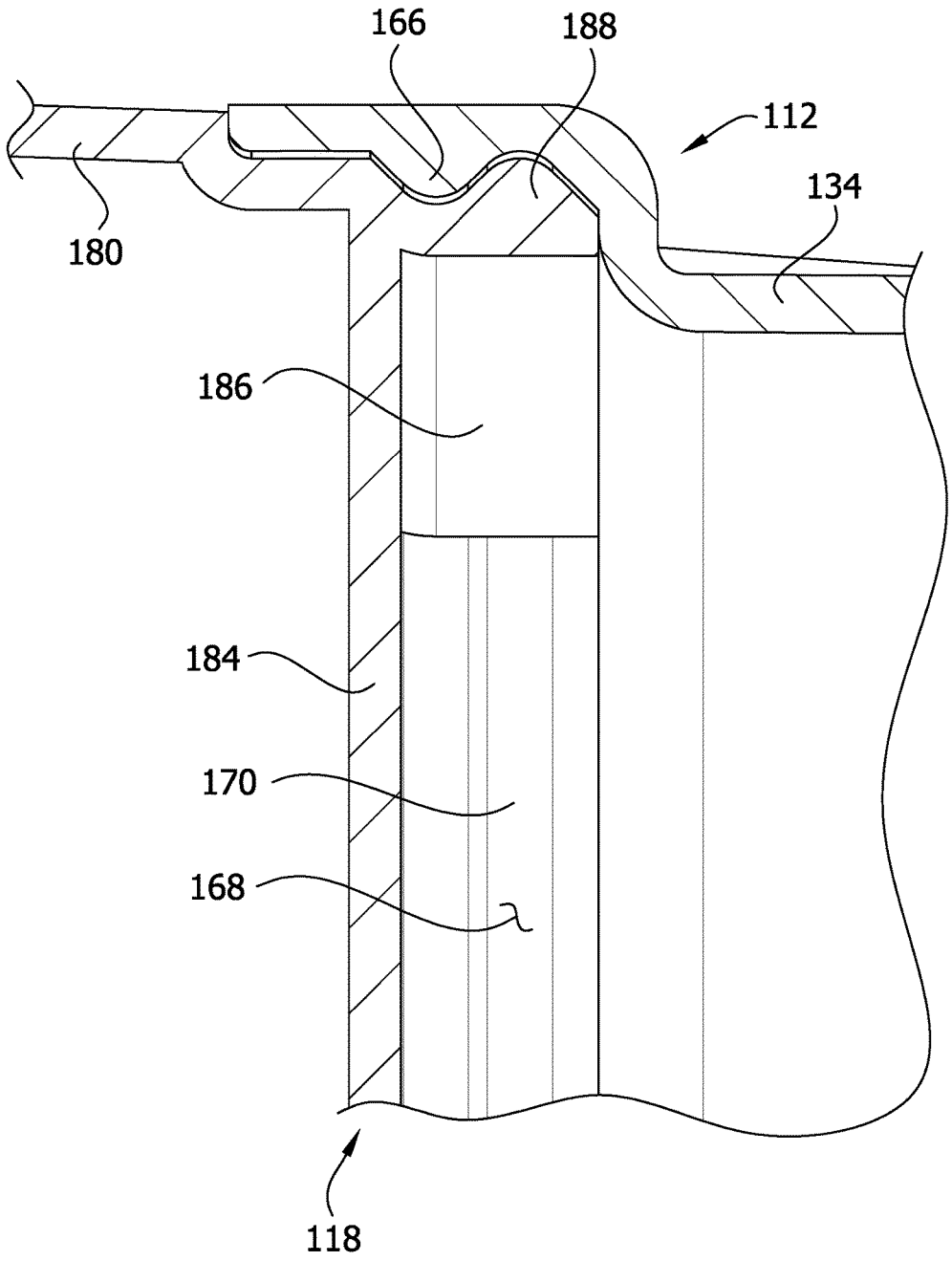
FIG. 6 is an enlarged fragmentary section of the handle member mounted on the female dispenser member.

As shown in FIG. 6, the tabs 186 of the handle member 118 are configured to be inserted into the open outer axial end portion 130 of the female dispenser member 112 so that the mounting tabs 186 extend axially inwardly beyond the retaining collar 166. The collar 166 is received in the collar-receiving recess 190, and the radially outwardly extending flange portions 188 are received in the annular recess 168. Preferably the mounting tabs 186 are resiliently deflectable to permit the radially outwardly extending flange portions 188 to snap over the collar 166 when the handle member 118 is inserted into the open outer axial end portion 130 of the female dispenser member 112. The flange portions 188 engage the collar 166 to inhibit the female dispenser member 112 from becoming unintentionally disconnected from the handle member 118. The annular collar 166 is substantially free to slide along the collar-receiving recesses 190 relative to the female dispenser member 112. In use, the female dispenser member 112 is substantially free to rotate conjointly with film roll R about the handle member 118 to unwind film from the film roll.

Figure 7:
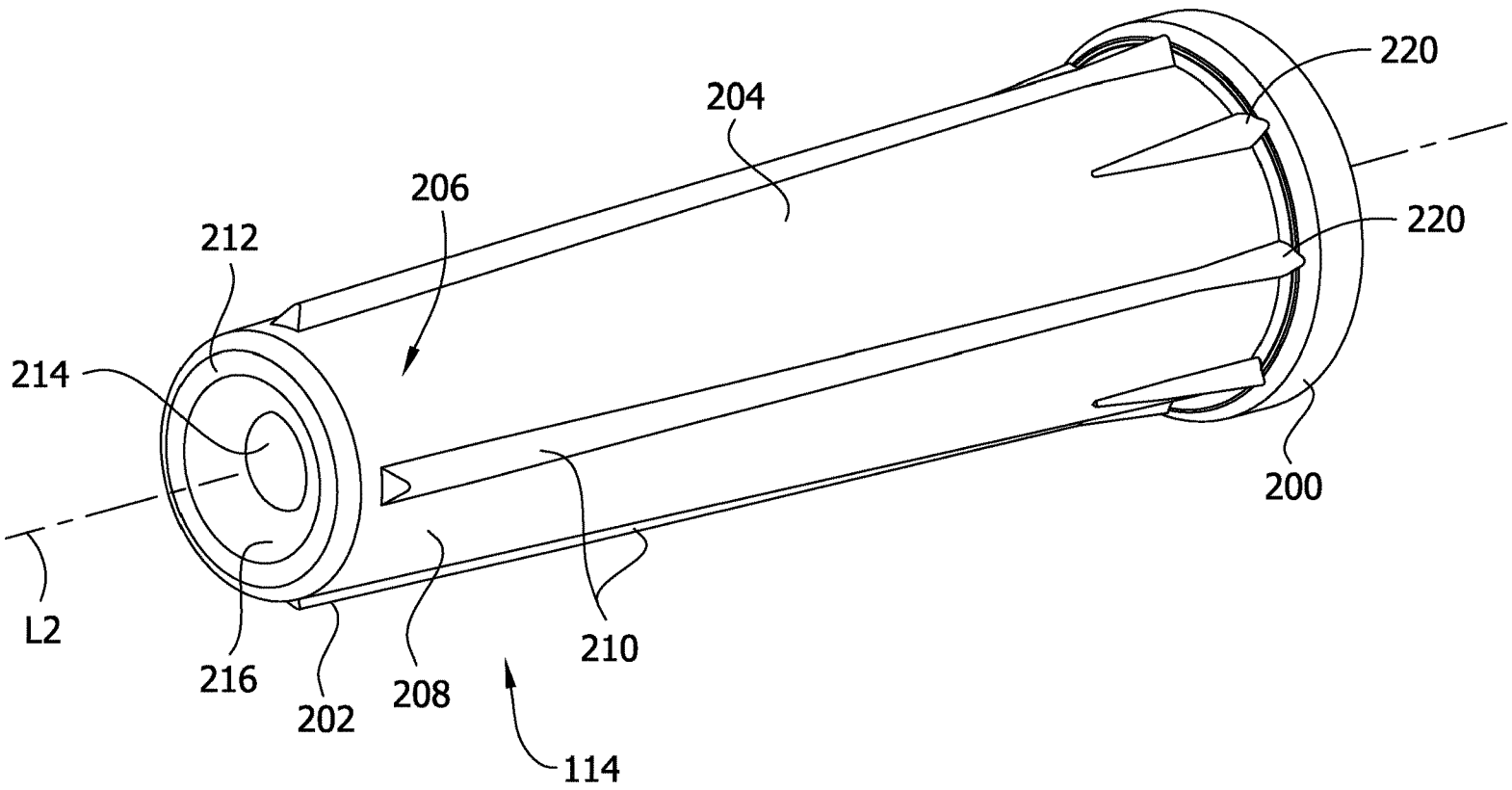
FIG. 7 is a perspective of a male dispenser member of the film dispenser.

Referring to FIG. 7, the illustrated male dispenser member 114 comprises a single one-piece, unitary structure of, for example, polyethylene material formed, for example, in an injection molding process. It will be understood that other materials and/or other manufacturing processes may be employed to make the male dispenser member 114 within the scope of the present invention. The male dispenser member 114 has an outer axial end portion 200 and an inner axial end portion 202 opposite the outer axial end portion. The outer and inner axial end portions 200, 202 are located along a longitudinal center axis L2 of the male dispenser member 114. The inner and outer axial end portions 202, 204 are defined substantially by a substantially cylindrical body 204. The inner axial end portion 202 of the cylindrical body 204 is configured to be inserted into the second opening O of the roll axis passage P of the coreless film roll R, and the outer axial end portion 200 of the cylindrical body 204 is configured to be mounted on the handle member 120 for rotation. The outer axial end portion 200 is constructed substantially identically to the outer axial end portion 130 of the female dispenser member 112. Likewise, the handle member 120 is constructed substantially identically to the handle member 118. It will be understood that the male dispenser member 114 is configured to be mounted on the handle member 120 for rotation with respect to the handle member just as the female dispenser member 112 rotates on the handle member 118. In other embodiments, either of the dispenser members could be mounted on the handle members in other ways without departing from the scope of the invention.

Figure 8:
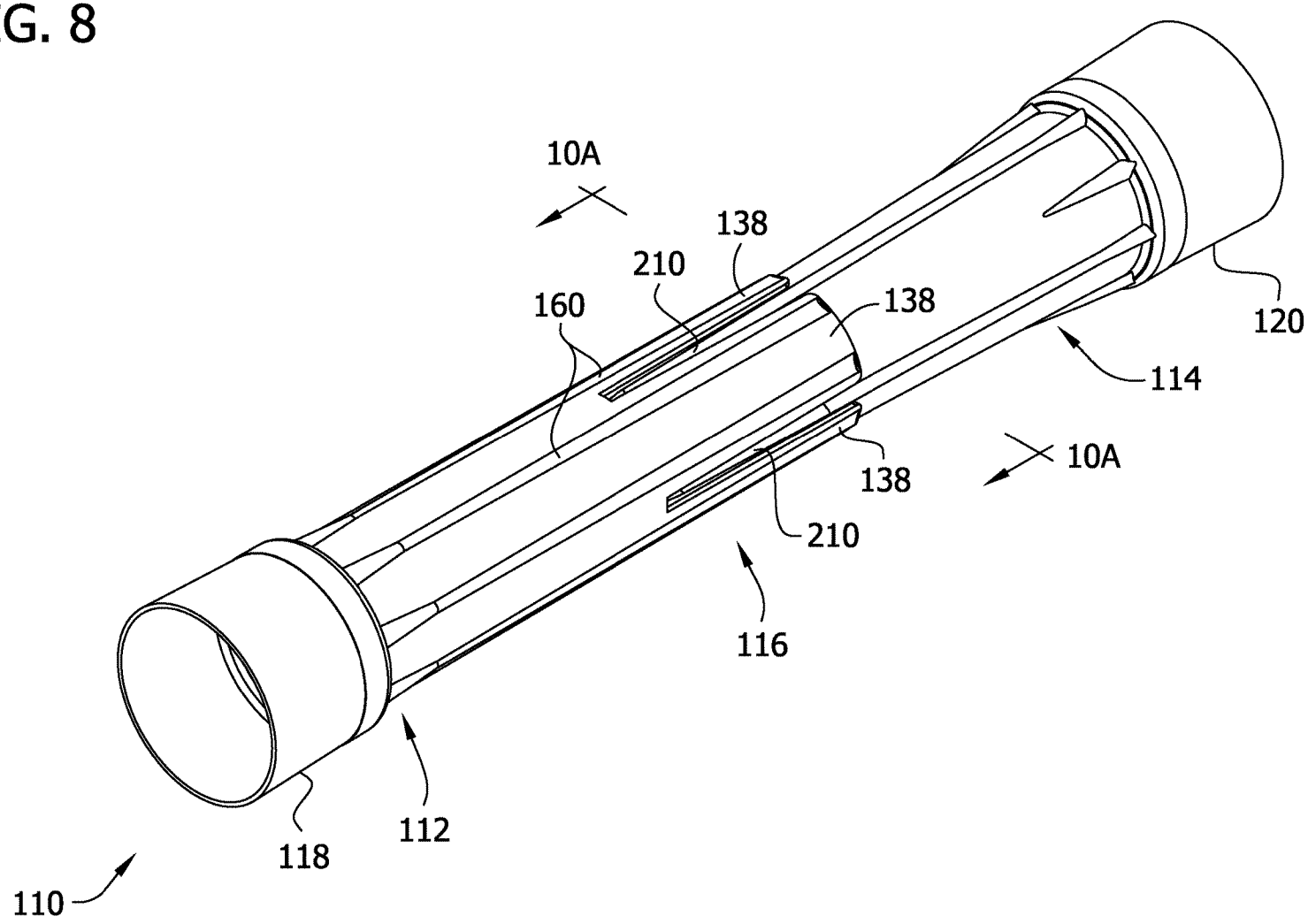
FIG. 8 is a perspective of the film dispenser with the male and female dispenser members positioned in a first angular position.
Figure 9:
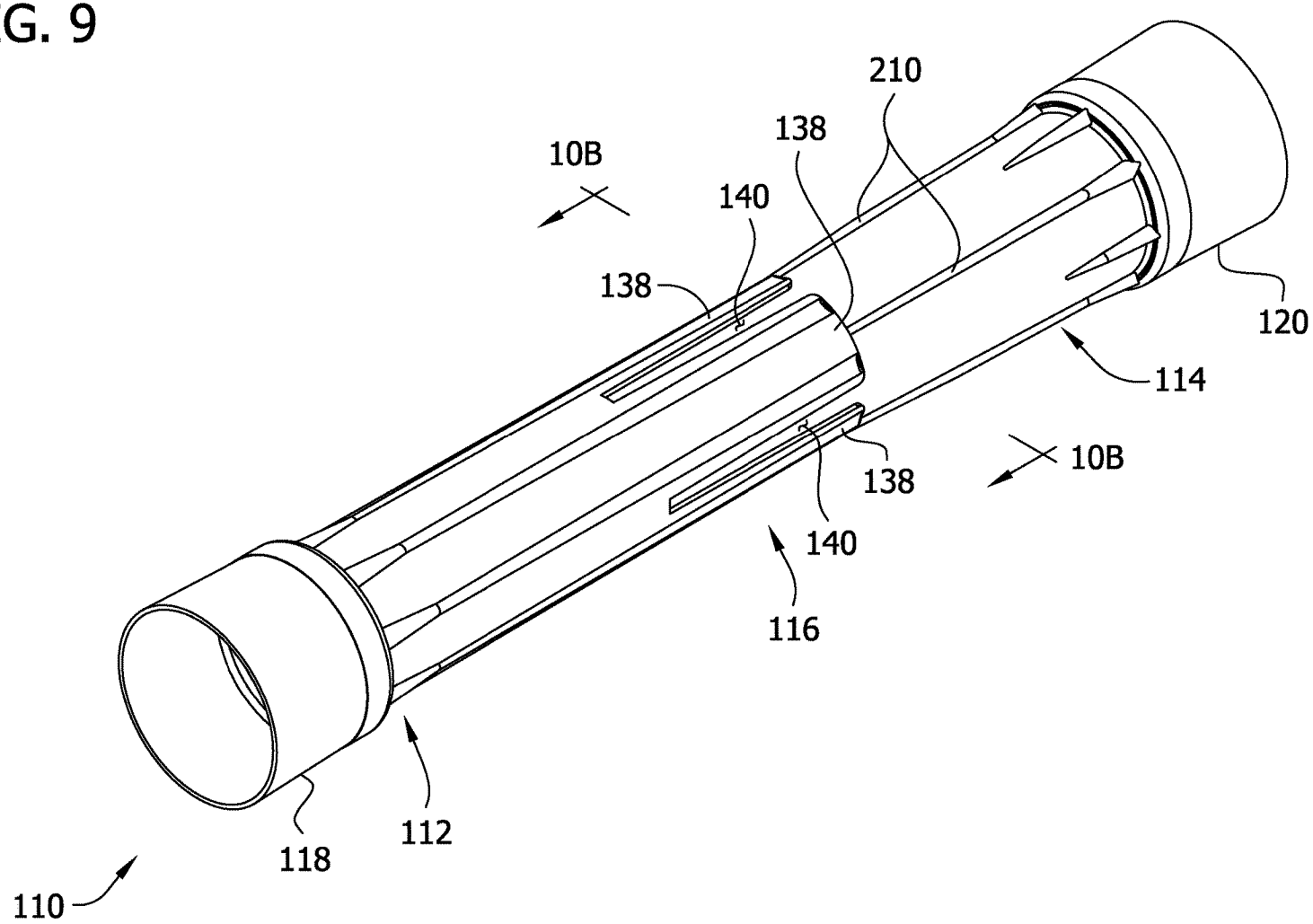
FIG. 9 is a perspective of the film dispenser with the male and female dispenser members positioned in a second angular position.

When the inner end portion of the male dispenser member 114 is received within the roll axis passage P of the film roll R along with the female dispenser member 112, the male dispenser member is configured to be joined in mated engagement with the female dispenser member, thereby forming the dispenser hub 116 within the roll axis passage P. As shown in FIGS. 8 and 9, the female and male dispenser members 112, 114, are selectively positionable relative to one another in a first angular position (FIG. 8) and a second angular position (FIG. 9). As shown in FIG. 7, the inner axial end portion 202 is shaped to define a mating portion 206 of the male dispenser member 114. The mating portion 206 is configured to be received within the mating socket 142 of the female dispenser member 112 in each of the first and second angular positions. In each of the first and second angular positions, the mating portion 206 of the male dispenser member 114 engages the radially inward facing surfaces 144 of the axially extending fingers 138 and thereby deflects the fingers radially outwardly. The radially outward facing surfaces 146 of the fingers 138 deflect radially outwardly to a first radial position when the female and male dispenser members 112, 114 are joined together in the first angular position (FIG. 8) and to a second radial position radially outward of the first radial position when the dispenser members are joined together in the second angular position (FIG. 9). The difference in radial deflection of the fingers 138 in the first and second angular positions enables dispenser hub 116 to engage the radially inward facing surfaces of a plurality of film rolls R (e.g., coreless film rolls) that have roll axis passages O of different radial dimensions so that the dispenser 110 can be used to dispense film from each of the plurality of film rolls.

The mating portion 206 of the male dispenser member 114 is shaped to substantially inhibit angular displacement of the female and male dispenser members 112, 114 relative to one another when joined together in either of the first and second angular positions. As shown in FIG. 7, the cylindrical body 204 of the male dispenser member 114 has a substantially annular, radially outward facing surface 208. The radially outward facing surface 208 tapers radially inwardly toward the inner axial end of the male dispenser member 114. Four indexing splines 210 (each, broadly, an "indexing formation") extend radially outwardly from the radially outward facing surface 208 and extend axially from adjacent the inner axial end to adjacent the outer axial end. In each of the first and second angular positions, the indexing splines 210 engage different portions of the female dispenser member 112 to inhibit angular displacement of the dispenser members 112, 114 relative to one another, thereby indexing the male and female dispenser members in the respective position. The splines 210 are also capable of gripping the coreless film roll R in the roll axis passage P to inhibit relative rotation between the coreless film roll and the dispenser 110.

As shown in FIG. 8, when the dispenser members 112, 114 are joined together in the first angular position, the mating portion 206 of the male dispenser member 114 is received in mating socket 142 of the female dispenser member and the indexing splines 210 are received in the axially extending slots 140. Each indexing spline 210 engages the opposed angularly outward facing side surfaces of a respective adjacent pair of the fingers 138. The engagement between the splines 210 and the fingers 138 inhibits angular displacement of the female and male dispenser members 112, 114 relative to one another. The substantially annular, radially outward facing surface 208 of the mating portion 206 engages the radially inward facing surface of the fingers 138 and deflects the fingers radially outwardly.

Figure 10A:
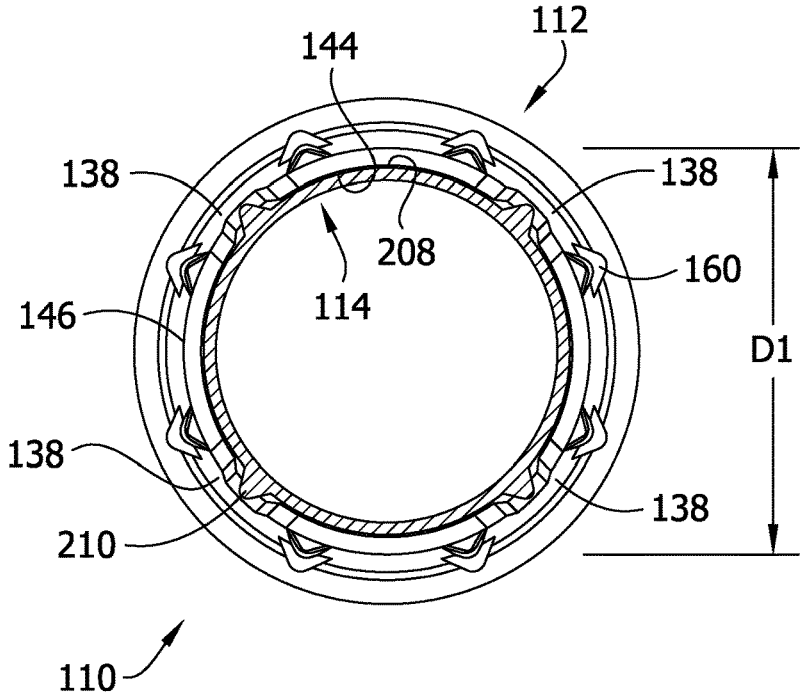
FIG. 10A is a section taken in the plane of line 10A-10A of FIG. 8.

As shown in FIG. 10A, when the dispenser members 112, 114 are joined together in the first angular position, the radially outward facing surfaces 146 of the fingers 138 are deflected to a first radial position at which the radially outward facing surfaces of opposite ones of the fingers are spaced apart from one another a first distance D1. In the illustrated embodiment, the radially outwardly extending ribs 160 extend beyond the first radial position of the radially outward facing surfaces 146 to engage the radially inward facing surface of the film roll R within the roll axis passage P in use. However, it will be understood that the ribs 160 could be omitted from the fingers 138 without departing from the scope of the invention. Because the mating portion 206 is tapered, by moving the male dispenser member 112 axially inwardly or outwardly through the mating socket 142, the radial position of the outward facing surfaces 146 can be finely adjusted, increasing or decreasing the length of the first distance D1. Preferably, when the female and male dispenser members 112, 114 are joined together in the first angular position within the roll axis passage P of the coreless film roll R, the axial position of the dispenser members relative to one another is adjusted so that the ribs 160 firmly engage (e.g., such as by causing radial deformation of) the radially inward facing surface of the film roll R and thereby inhibit rotation of the film roll with respect to the dispenser hub 116.

As shown in FIG. 9, when the dispenser members 112, 114 are joined together in the second angular position, the mating portion 206 of the male dispenser member is received in the mating socket 142 of the female dispenser member and the indexing splines 210 are angularly aligned with the axially extending fingers 138. The radially outward facing surfaces of the indexing splines 210 engage the radially inward facing surfaces 144 of the fingers 138. The engagement between the indexing splines 210 and the fingers 138 inhibits angular displacement of the male dispenser member 114 relative to the female dispenser member 112. In addition, the engagement between the indexing splines 210 and the fingers 138 deflects the fingers radially outwardly.

Figure 10B:
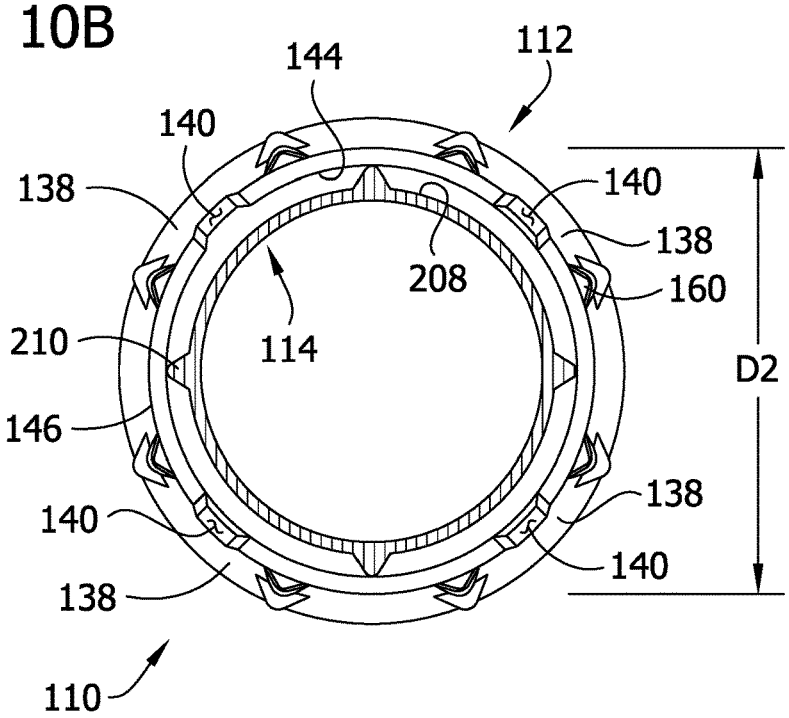
FIG. 10B is a section taken in the plane of line 10B-10B of FIG. 9.

As shown in FIG. 10B, when the dispenser members 112, 114 are joined together in the second angular position, the radially outward facing surfaces 146 of the fingers 138 are deflected to a second radial position radially outward of the first radial position shown in FIG. 10A. When the fingers 138 are deflected to the second radial position shown in FIG. 10B, the radially outward facing surfaces 146 of opposite ones of the fingers are spaced apart from one another a second distance D2. Like the radially outward facing surface 208, the radially outward facing surfaces of the indexing splines 210 taper radially inwardly adjacent their respective inner axial ends. Accordingly, by moving the male dispenser member 114 axially inwardly or outwardly relative to the female dispenser member 112 when the dispenser members are joined together in the second angular position, the position of the outward facing surfaces 146 can be finely adjusted. Preferably, when the dispenser members 112, 114 are joined together in the second angular position within the roll axis passage P of the coreless film roll R, the axial position of the dispenser members relative to one another is adjusted so that the ribs 160 firmly engage the radially inward facing surface of the film roll R and thereby inhibit rotation of the film roll with respect to the dispenser hub 116.

The fingers 138 of the female dispenser member 112 deflect to firmly engage the radially inward facing surface of coreless film rolls R that contract after manufacturing. After a manufacturer produces coreless film rolls R with an initial internal diameter, the film contracts over time, resulting in roll axis passages P that have reduced internal diameters that are less than the initial internal diameter. The combined adjustability of the dispenser 110 in the first and second angular positions may permit the dispenser to operatively engage any film roll R manufactured to have an initial internal diameter that has contracted to a reduced internal diameter within a certain range of the initial internal diameter. For example, in one or more embodiments, the fingers 138 of the female dispenser member 112 deflect radially outwardly to firmly engage film rolls R that have a reduced internal diameter of from about 85% to about 97%, from about 86% to about 95%, or from about 87% to about 93% of an initial manufactured internal diameter. In other embodiments, the distances D1, D2 at which the fingers 138 are spaced apart from one another in the first and second angular positions are each from about 85% to about 97%, from about 86% to about 95%, or from about 87% to about 93% of an initial internal diameter of a film roll R as it is manufactured.

It will be understood that, in the illustrated embodiment, the radially outward facing surfaces of the ribs 160 function as an expandable outward facing surface of the female dispenser member 112. Moreover, by selecting between the first and second angular positions, a user can adjust the radial position of the expandable outward facing surface of the female dispenser member 112 to engage the radially inward facing surfaces of any of a plurality of film rolls R having roll axis passages P of different radial dimensions. The splines 210 of the male dispenser member 114 fix the dispenser members 112, 114 in a selected one of the first and second angular positions so that the deflectable outward facing surface of the female dispenser member 112 remains firmly engaged with the radially inward facing surface of the film roll R in use.

Although the illustrated embodiment uses the indexing splines 210 and indexing slots 140 as indexing formations to fix the dispenser members 112, 114 in either of the first and second angular positions, it will be understood that other embodiments can use other types of indexing formations to inhibit angular displacement of one of the dispenser members relative to the other from selected angular positions. Moreover, though the illustrated embodiment includes indexing formations 140, 210 that index the dispenser members 112, 114 in two angular positions, other embodiments can index dispenser members in other numbers of angular positions without departing from the scope of the invention. Preferably, the dispenser members will include one or more indexing formations that fix the dispenser members in a plurality of angular positions, each of which causing expansion of an outer radial surface of one of the dispenser members to firmly engage a radially inward facing surface of a film roll with a roll axis passage of a different radial dimension.

Referring again to FIG. 7, the mating portion 210 of the male dispenser member 114 comprises an axially inward facing support wall 212 extending transverse (e.g., perpendicular) to the longitudinal axis L2. The inward facing support wall 212 is located in the inner axial end portion 202 of the cylindrical body 204. As shown in FIG. 2, when the dispenser members 112, 114 are joined together to form the dispenser hub 116, the inward facing support wall 212 can engage the opposed inward facing support wall 150 of the female dispenser member 112. Within the roll axis passage P, the engaged support walls 212 provide radial support for an axially central portion of the film roll R to inhibit the film roll from deforming radially inwardly in use.

The support wall 212 is configured for interlocking engagement with the support wall 150 of the female dispenser member 112. As shown in FIG. 7, the support wall 212 of the male dispenser member 114 includes a cup 214 (broadly, an interlocking formation). As shown in FIG. 2, when the mating portion 210 of the male dispenser member 114 is received in the mating socket 142 of the female dispenser member 112, the axially extending projection 152 of the female dispenser member is received in the cup 214. The cup can, in certain embodiments, be sized to form an interference or friction fit with the projection 152 received therein.

The cup 214 and the projection 152 are positioned relative the respective dispenser member 112, 114 to be radially aligned when the dispenser members are received in a roll axis passage P. In that regard, the male dispenser member 114 includes a funnel surface 216 surrounding the cup 214 that can engage and guide the projection 152 into the cup. In the illustrated embodiment, the cup 214 is centered on the longitudinal center axis L2 of the male dispenser member 114, and the projection 152 is centered around the longitudinal center axis L1 of the female dispenser member 112. When the female and male dispenser members 112, 114 are received in the roll axis passage P, their interengagement also makes the longitudinal axes L1, L2 of the dispenser members generally co-axial, thereby allowing the tapered end of the mating portion 206 to enter the mating socket 142. Although the interlocking projection 152 and cup 214 are radially centered in the illustrated embodiment, it will be understood that the interlocking formations could be radially aligned at other non-centered positions without departing from the scope of the invention.

The support walls 150, 212 are shaped and arranged so that the projection 152 is automatically received in the cup 214 as the dispenser members 112, 114 are joined together within a roll axis passage P of the coreless film roll R. The female dispenser member 112 is configured to be inserted into a first opening O of the roll axis passage P by moving the dispenser member through the first opening along the longitudinal axis L1. Likewise, the male dispenser member 114 is configured to be inserted into the opposite second opening O of the roll axis passage P by moving the dispenser member through the roll axis passage along the longitudinal axis L2. Reception of the mating portion 206 of the male dispenser member 114 in the mating socket 142 of the female dispenser member 112 begins to bring the female and male dispenser members into alignment. The tapered inner axial end of the mating portion 206 of the male dispenser member 114 facilitates entry of the mating portion to the mating socket 142. More precise alignment is achieved when the projection 152 engages the funnel surface 216 and is guided into the cup 214. No additional positional adjustment (e.g., radial or angular adjustment) beyond inserting the dispenser members 112, 114 axially into opposite ends of the roll axis passage P is required to insert the projection 152 into the cup 214 and thereby create a rigid connection between the support walls 150, 212.

The interlocking engagement between the cup 214 and the projection 152 provides a rigid connection between the support walls 150, 212. When the dispenser members 112, 114 are joined together within the roll axis passage P, the support walls 150, 212 span generally the entire radial extent of the roll axis passage. Each wall 150, 212 functions, individually, as a support structure that supports the film roll R against bowing or otherwise deforming radially inwardly near the axially central region of the film roll. With the projection 152 engaging the cup 214, the support walls 150, 212 form a rigid connection between the dispenser members 112, 114 within the film roll R. Together, the rigidly connected support walls 150, 212 provide radial support for the central region of film roll R and inhibit significant deformation of the film roll adjacent the central region of the film roll.

It will be understood that other types of interlocking formations other than the projection 152 and cup-shaped surface 212 could be used to create a rigid connection between the dispenser members without departing from the scope of the invention. For example, it is specifically contemplated that the male dispenser member could include a support wall defining an axially inwardly extending projection configured to be received in a cup formed in a support wall of the female dispenser member. Still other interlocking formations and configurations can be used without departing from the scope of the invention.

Like the female dispenser member 112, the male dispenser member 114 includes eight ribs 220 that slope inwardly from adjacent the outer axial end of the cylindrical body 204. When the male dispenser member 114 is inserted into the second opening O of the roll axis passage P, the ribs 120 firmly engage the radially inward facing surface of the film roll R to provide radial support for the respective axial end of the film roll.

In use, a user inserts the female dispenser member 112 into the first opening O of a roll axis passage P and inserts the male dispenser member 114 into the second opening O of the roll axis passage. For the female dispenser member 112, the user may compress the fingers 138 radially inwardly to facilitate insertion into the roll axis passage P. If the roll axis passage has a relatively small radial dimension, the dispenser members 112, 114 should be angularly aligned so that the indexing slots 140 receive the indexing splines 210 as the mating portion 206 of the male dispenser member is received in the mating socket 142 of the female dispenser member. If the roll axis passage P has a relatively large radial dimension, the dispenser members 112, 114 should be angularly aligned so that the indexing splines 210 are angularly aligned with the fingers 138 as the mating portion 206 is received in the mating socket 142. Suitable markings (not shown) may be provided on the dispenser members 112, 114 to facilitate the proper rotational alignment. In either case, the user inserts the dispenser members 112, 114 into the first and second openings O of the roll axis passage P until the radially outward facing surfaces of the ribs 160 firmly engage the radially inward facing surface of the film roll R. As the fingers 138 are being deflected radially outwardly, the projection 152 is simultaneously being received in the cup 214, without any radial or angular positional adjustment of the dispenser members 112, 114 on the part of the user. When the fingers 138 firmly engage the radially inward facing surface of the film roll R, the dispenser members 112, 114 are joined together and form the dispenser hub 116. Additionally, inner and outer axial end portions of the ribs 160 of the female dispenser member 112 and the ribs 220 of the male dispenser member engage the inward facing surface of the film roll to inhibit rotation of the film roll with respect to the dispenser hub in use.

A user grasps the handle members 118, 120 and secures the free end F of the film to the item to be wrapped. While holding the handle members 118, 120, the user passes the film dispenser 110 and film roll R around the item in a wrapping direction. The movement of the dispenser 110 in the wrapping direction creates tension in the film that causes the film to unwind from the roll R. The film roll R and core hub 116 freely rotate together on the handle members 118, 120 to let out film from the roll R. The support walls 150, 212 provide radial support for the central portion of the film roll R in use to prevent the film roll from bowing or otherwise deforming radially inward into the roll axis passage P. When the item is fully wrapped, the film can be cut to detach the dispenser 110 from the wrapped object. As film is wound off from the film roll R, the support walls 150, 212 continue to provide radial support for central region of the film roll, even though the film roll itself reduces in diameter and becomes more deformable. When all the film from a first film roll R has been used or a new film roll is desired, the dispenser 110 can be quickly and easily inserted into the roll axis passage of another film roll, even if the roll axis passage of the other film roll is sized differently than the first film roll.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A film dispenser for use in unwinding film from coreless film rolls each having a roll axis passage including first and second openings at opposite ends of the coreless film roll, the film dispenser comprising:

a first dispenser member having an outer axial end portion and an inner axial end portion opposite the outer axial end portion, the inner axial end portion of the first dispenser member being shaped and arranged to be inserted into the first opening at one end of the coreless film roll, the inner axial end portion of the first dispenser member being radially expandable to engage the coreless film roll in the roll axis passage; and a second dispenser member having an outer axial end portion and an inner axial end portion opposite the outer axial end portion, the inner axial end portion of the second dispenser member being shaped and arranged to be inserted into the second opening at another end of the coreless film roll, the second dispenser member being configured to engage the first dispenser member, the first and second dispenser members being selectively positionable relative to one another when interengaged in at least a first angular position and a second angular position, the inner axial end portion of the first dispenser member having a first radial position upon engagement of the first and second dispenser members in the first angular position, and the inner axial end portion of the first dispenser member being expanded to a second radial position upon engagement of the first and second dispenser members in the second angular position, the second radial position being radially outward of the first radial position.

2. A film dispenser as set forth in claim 1 wherein the first dispenser member radially expands to the first radial position upon engagement with the second dispenser in the first angular position.

3. A film dispenser as set forth in claim 1 wherein the second dispenser member comprises a radially outwardly extending indexing spline.

4. A film dispenser as set forth in claim 3 wherein the first dispenser member comprises an indexing slot.

5. A film dispenser as set forth in claim 4 wherein the indexing slot is sized and shaped to receive the indexing spline therein in the first angular position of the dispenser members.

6. A film dispenser as set forth in claim 5 wherein the second dispenser member comprises radially outward facing surface and the indexing spline extends radially outward from the radially outward facing surface.

7. A film dispenser as set forth in claim 6 wherein the radially outward facing surface of the second dispenser member is configured to engage a radially inward facing surface of the first dispenser member and thereby expand the radially outward facing surface of the first dispenser member outwardly to the first radial position when the first and second dispenser members are in the first angular position.

8. A film dispenser as set forth in claim 3 wherein the inner axial end portion of the first dispenser member comprises at least one radially deflectable axially extending finger.

9. A film dispenser as set forth in claim 1 wherein the inner axial end portion of the first dispenser member comprises at least one radially deflectable axially extending finger.

10. A film dispenser as set forth in claim 9 wherein the second dispenser member comprises an indexing spline configured to engage a radially inward facing surface of the axially extending finger and deflect the finger radially outward to the second radial position when the first and second dispenser members are in the second angular position.

11. A film dispenser for use in unwinding film from coreless film rolls each having a roll axis passage including first and second openings at opposite ends of the coreless film roll, the film dispenser comprising:

a first dispenser member having a longitudinal axis, an outer axial end portion, and an inner axial end portion spaced apart from the outer axial end portion along the longitudinal axis, the inner axial end portion of the first dispenser member being shaped and arranged to be inserted into a first opening of a roll axis passage of the film roll, the first dispenser member further comprising an axially inward facing support wall including a first interlocking formation; and a second dispenser member having a longitudinal axis, an outer axial end portion, and an inner axial end portion spaced apart from the outer axial end portion along the longitudinal axis, the inner axial end portion of the second dispenser member being shaped and arranged to be inserted into the second opening of the roll axis passage, the second dispenser member being shaped and arranged to engage the first dispenser member, the second dispenser member further comprising an axially inward facing support wall including a second interlocking formation configured for interlocking engagement with the first interlocking formation when the second dispenser member engages the first dispenser member within the roll axis passage for supporting an axial mid-portion of the coreless film roll.

12. A film dispenser as set forth in claim 11 wherein the engagement of the first and second interlocking formations is configured to resist movement of the first and second dispenser members away from a substantially co-axial position.

13. A film dispenser as set forth in claim 12 wherein one of the first and second interlocking formations comprises a projection located radially inward of the support wall of the one of the first and second dispenser members and the other of the first and second interlocking formations defines a recess for receiving the projection, the recess being located radially inward of the support wall of the other of the first and second dispenser members.

14. A film dispenser as set forth in claim 11 wherein the second interlocking formation is configured to align the first and second dispenser members upon engagement of the first interlocking formation with the second interlocking formation.

15. A film dispenser as set forth in claim 14 wherein the first interlocking formation comprises a projection and the second interlocking formation defines a recess for receiving the projection and a funnel surface adjacent the recess for guiding the projection into the recess.

16. A film dispenser as set forth in claim 11 wherein the first dispenser member is configured to be inserted into the first opening of the roll axis passage by moving the first dispenser member relative to the film roll along the longitudinal axis of the first dispenser member and wherein the second dispenser member is configured to be inserted into the second opening of the roll axis passage by moving the second dispenser member relative to the film roll along the longitudinal axis of the second dispenser member.

17. A film dispenser as set forth in claim 11 wherein the first dispenser member comprises a mating socket.

18. A film dispenser as set forth in claim 17 wherein the second dispenser member comprises a mating portion configured to be received in the mating socket of the first dispenser member when the first and second dispenser members are received in the roll axis passage of the coreless film roll.

19. A film dispenser as set forth in claim 18 wherein the support wall of the first dispenser member bounds an outer axial end portion of the mating socket and wherein the support wall of the second dispenser member is positioned adjacent an inner axial end portion of the mating portion.

20. A film dispenser as set forth in claim 18 wherein the mating portion of the second dispenser member is configured to engage the inner axial end portion of the first dispenser member in the mating socket to expand the inner axial end portion when the mating portion is received in the mating socket.

21. A film dispenser as set forth in claim 11 wherein the axially inward facing support wall of the first dispenser member is located at an axial end of the first dispenser member and the axially inward facing support wall of the second dispenser member is located at an axial end of the second dispenser member, the first and second dispenser members being arranged to engage each other when the first and second dispenser members are engaged.

* * * * *